US005976745A

United States Patent [19]

Aoki et al.

[11] Patent Number: 5,976,745

[45] Date of Patent: Nov. 2, 1999

[54] PHOTOSENSITIVE MEMBER FOR ELECTROPHOTOGRAPHY AND FABRICATION PROCESS THEREOF

[75] Inventors: Makoto Aoki, Joyo; Shigenori Ueda; Junichiro Hashizume, both of Nara, all of Japan

[73] Assignee: Canon Kabushiki Kaisha, Tokyo, Japan

[21] Appl. No.: 08/924,309

[22] Filed: Sep. 5, 1997

[30] Foreign Application Priority Data

Sep. 6, 1996 [JP] Japan ..... 8-236421

[51] Int. Cl.[6] ..... G03G 5/147

[52] U.S. Cl. ..... 430/66; 430/67; 430/128

[58] Field of Search ..... 430/66, 67, 128

[56] References Cited

U.S. PATENT DOCUMENTS

| | | | |
|---|---|---|---|
| 4,265,991 | 5/1981 | Hirai et al. | 430/64 |
| 5,582,944 | 12/1996 | Yamamura et al. | 430/66 |
| 5,670,286 | 9/1997 | Takei et al. | 430/66 |

FOREIGN PATENT DOCUMENTS

| | | |
|---|---|---|
| 61-289354 | 12/1986 | Japan . |
| 64-84257 | 3/1989 | Japan . |

OTHER PUBLICATIONS

Curtins, et al., Influence of Plasma Excitation Frequency for α–Si:H Thin Film Deposition, Plasma Chem. and Plasma Process., vol. 7, No. 3, pp. 267–273.

*Primary Examiner*—Roland Martin

*Attorney, Agent, or Firm*—Fitzpatrick, Cella, Harper & Scinto

[57] ABSTRACT

With a plasma being generated between a cathode electrode to which a high-frequency power is applied and an electrically conductive substrate opposed to the electrode in a reaction vessel the pressure of which can be reduced, a photoconductive layer having the matrix of silicon atoms is deposited on a substrate to be processed, a surface layer comprised of non-monocrystal carbon containing hydrogen is provided on the photoconductive layer, a surface of the surface layer is etched to fluorinate the surface, the surface roughness Rz by etching is controlled below 1000 Å, the fluorine contained in the surface layer is made present within 50 Å from the surface, and the concentration of fluorine to carbon in that region is 20% or more, thereby providing a photosensitive member for electrophotography that can obtain high-quality images free of image faintness and image smearing without using a heating means for the photosensitive member, that has high durability, that shows less change in potential characteristics, that can obtain high-quality images on a stable basis, and that is free of the ghost phenomenon and providing a fabrication process of the photosensitive member.

14 Claims, 4 Drawing Sheets

PHOTOSENSITIVE MEMBER FOR ELECTROPHOTOGRAPHY AND FABRICATION PROCESS THEREOF

BACKGROUND OF THE INVENTION

1. Field of the Invention

The present invention relates to a photosensitive member for electrophotography and a fabrication process thereof and, more particularly, to a photosensitive member for electrophotography that can obtain high-quality images free of image faintness and image smearing with no heating means for photosensitive member, that has high durability enough to maintain the characteristics, that exhibits less variation in potential characteristics, that can obtain high-quality images on a stable basis, that experiences no ghost phenomenon, and to a fabrication process thereof for achieving the performance thereof with good repeatability.

2. Related Background Art

Proposed for a light receiving layer used in the photosensitive member for electrophotography are a variety of materials including selenium, cadmium sulfide, zinc oxide, phthalocyanine, amorphous silicon (hereinafter referred to as a-Si), and so on. Among others, non-monocrystalline deposited films containing silicon atoms as a main ingredient typified by a-Si, for example, amorphous deposited films of a-Si or the like compensated by hydrogen and/or halogen (for example, fluorine, chlorine, or the like), are proposed as high-performance, high-durability, and nonpolluting photosensitive members, some of which are used practically. U.S. Pat. No. 4,265,991 discloses the technology of the electrophotographic, photosensitive member the photoconductive layer of which is formed mainly of a-Si.

The a-Si photosensitive members have high surface hardness, demonstrate high sensitivity also to long-wavelength light of semiconductor lasers (770 nm to 800 nm) and the like, and exhibit little deterioration after repetitive use, and they are widely used, particularly, as photosensitive members for electrophotography in high-speed copiers, LBPs (laser beam printers), and the like.

As methods for forming such deposited films there are many conventional methods known, including the sputtering process, the method for decomposing source gas by heat (the thermal CVD process), the method for decomposing the source gas by light (the photo-CVD process), the method for decomposing the source gas by plasma (the plasma enhanced CVD process), and so on.

Among them, the plasma CVD process, which is a method for decomposing the source gas by glow discharge or the like induced by direct current, high-frequency (RF or VHF) wave, or microwave and for forming a deposited film of thin film on a substrate of glass, quartz, heat-resistive, synthetic resin film, stainless steel, aluminum, or the like, is now under very quick development into practical use as a method for forming the a-Si deposited films for electrophotography. A variety of proposals were also made on apparatus for the process.

Further, demands are becoming stronger for improvements in quality of film and in throughput and many ideas are under research.

Especially, the plasma process using high-frequency power is used because of its various advantages including high stability of discharge, applicability to formation of insulating materials such as oxide film, nitride film, and so on.

A process recently reported is the plasma enhanced CVD process with high-frequency power supply of 50 MHz or higher by use of a parallel plate plasma enhanced CVD system (Plasma Chemistry and Plasma Processing, Vol. 7, No. 3 (1987), pp. 267–273), which shows a possibility that the rate of deposition can be increased without degrading the performance of a deposited film by using the frequency of discharge higher than 13.56 MHz conventionally used and which is drawing attention. There are also reports of increasing the frequency of discharge in sputtering etc. and wide research is under way in recent years.

In applications of the a-Si photosensitive members fabricated by these methods to the electrophotographic apparatus, charging and decharging (charge-eliminating) means of photosensitive members used in the most cases are corona chargers (Corotron, Scorotron) composed of main components of a wire electrode (a metal wire such as a tungsten wire with gold plating in 50 to 100 $\mu$mϕ) and a shield plate. Specifically, charging or decharging (elimination of charge) of the surface of the photosensitive member is effected by applying a high voltage (approximately 4 to 8 kV) to the wire electrode of the corona charger and causing corona electric current generated with the application of the voltage to act on the surface of the photosensitive member. The corona chargers are excellent in uniform charging and decharging.

However, ozone ($O_3$) is generated with corona discharge to oxidize nitrogen in the air to generate nitrogen oxides ($NO_x$) etc. In addition, the nitrogen oxides etc. thus generated react with water in the air to generate nitric acid etc. Then the products by the corona discharge, including nitrogen oxides, nitric acid, etc., adhere to and are deposited on the photosensitive member and peripheral devices, thus polluting surfaces thereof.

Since the corona discharge products are highly hygroscopic, the surface of photosensitive member adsorbing them decreases its resistance because of absorption of moisture by the corona discharge products thus deposited, so as to substantially degrade the charge holding ability totally or partly, which is a cause to induce defects of image as called image faintness and image smearing (a pattern of electrostatic latent image is destroyed or is not formed because of leakage of charge on the surface of photosensitive member in directions along the surface).

The corona discharge products, depositing on the internal surface of shield plate in the corona charger, are volatilized and liberated not only during operation of electrophotographic apparatus, but also during rest of apparatus, for example, during the night and then adhere to the surface of photosensitive member in the region corresponding to the discharge opening of the charger. Such corona discharge products further absorb moisture to decrease the resistance of the surface of photosensitive member. Therefore, with the first copy or several copies outputted initially at restart of apparatus after rest of apparatus, the image faintness and the image smearing tend to take place in the aforementioned region corresponding to the charge opening in the rest of apparatus. This phenomenon sometimes appears prominent, especially, when the corona charger is an AC corona charger.

Particularly, when the photosensitive member is an a-Si photosensitive member, the problems of image faintness and image smearing due to the above corona discharge products become more serious. Specifically, since the a-Si photosensitive member has lower efficiency of charging and decharging than the other photosensitive members (it requires more electric current of corona charging for obtaining a predetermined charging or decharging potential), the charging current amount is increased greatly by applying a higher voltage to the charger than in the case of the other photosensitive members, in the charging and decharging processes by corona discharge to the a-Si photosensitive member.

Since an amount of ozone generated is in proportional relation with the current amount of corona charging, in the case of the arrangement wherein the photosensitive member is the a-Si photosensitive member and wherein it is charged or decharged by corona charging, the amount of ozone generated particularly becomes large, which could make the problems of image faintness and image smearing due to generation of the aforementioned corona discharge products particularly serious in some cases. In addition, in the case of the a-Si photosensitive member, the surface hardness thereof is extremely higher than those of the other photosensitive members, and the extremely high surface hardness inversely acts to keep the corona discharge products on the surface of photosensitive member, remaining indefinitely.

The following two methods are considered to be methods for preventing the phenomena of image faintness and image smearing.

(1) The first method is a method for decreasing relative humidity by heating the surface of the photosensitive member (up to 30 to 50° C.) by a heater for heating the photosensitive member built in the photosensitive member or by hot air supplied from a hot wind supplying device to the photosensitive member. This method is a process for preventing the substantial decrease in resistance of the surface of photosensitive member by volatilizing the corona discharge products and water adhering to the surface of photosensitive member and this method is in practical use.

(2) The second method is a method for increasing the water repellency of the surface so as to make the corona discharge products hard to adhere to the surface from the beginning, thereby preventing the image smearing. For example, the bulletin of Japanese Patent Application Laid-Open No. 61-289354 discloses an a-C surface layer a surface of which is plasma-processed with a gas containing fluorine. Further, the bulletin of Japanese Patent Application Laid-Open No. 64-84257 discloses an electrophotographic, photosensitive member wherein the surface of a surface layer comprised of amorphous carbon containing fluorine has unevenness 0.1 to 0.5 $\mu$m deep and 0.1 to 1 $\mu$m wide, and a fabrication process thereof. It is described that this method can further increase water repellency by increasing the surface area.

While the problem of image smearing was solved by the heating device of a drum in the above-stated method of (1), new problems described below arose with recent growing demands for copiers. Namely, circumstances have been changing so that use of the heating means by drum heater should be preferably avoided from the viewpoints of energy saving and ecology.

Another problem arises when the a-Si drum assuring high quality of image is mounted in a full-color copier. The problem is to increase a possibility of fusing and sticking low-melting-point toner of color toner or the like onto the surface of drum. Still another problem is that image densities change partly depending upon cycles of rotation of a rotary, cylindrical developer-carrying member.

The reason is that during rest of the apparatus the heat of the photosensitive member expands the rotary, cylindrical developer-carrying member to decrease the distance to the portion of photosensitive member opposed thereto, whereby the developer becomes easier to transfer than in the normal condition. These problems raised demands for a photosensitive member free from occurrence of image faintness and image smearing without heating.

On the other hand, as to the technology for increasing water repellency as disclosed in the aforementioned bulletins in the above-stated method of (2), the bulletins describe the increase in water repellency by exposure to ozone, but they describe nothing about whether durability tests were conducted or not by carrying out a large number of copying operations in actual.

Then the inventors conducted follow-up tests according to the method disclosed in the bulletin of Japanese Patent Application Laid-Open No. 61-289354 to carry out durability tests of performing continuous copying operations without use of heating means. The durability tests verified that durability was insufficient, though the image smearing characteristics at an initial stage were improved in fact. It was found that a property of being capable of maintaining necessary and sufficient water repellency even after sheet-pass durability tests of many sheets was more preferable in consideration of the high durability as one of merits of the a-Si photosensitive member.

The inventors also conducted follow-up tests of the method disclosed in the bulletin of Japanese Patent Application Laid-Open No. 64-84257. In this case, it was confirmed that increasing the surface area by providing the surface with unevenness was effective in increasing water repellency, but it was also found that the effect of water repellency decreased with progress of sheet-pass durability test. A reason of this is possibly that amorphous carbon containing fluorine is soft and thus is shaved gradually by slip abrasion with members around the photosensitive member, paper, or the like.

Under these circumstances, the desire has been growing for a photosensitive member that has a surface layer with high water repellency so as not to cause the image faintness or the image smearing without use of heating means and that exhibits no degradation of the high water repellency even after copying operations of many sheets for a long period.

With recent increase in the requirements for copy images, in addition to the problem of image smearing, there is earnest desire for the technology for supplying high-quality images on a stable basis. Since uses of copier have been changing from copy originals mainly containing letters to images of photographs or the like to increase copy originals frequently using halftones, a severer standard than before is required for stability of density. When potentials of charging vary with time against the desire to keep charging equal as described above, the change of potential is called a potential shift, and the smaller the potential shift, the higher the stability.

With photographic originals, the requirement becomes severer as to the ghost phenomenon as well as the stability of density. This is because halftone portions are likely to be affected especially by ghost. The "ghost" herein is a phenomenon that an image in previous copying operation is visualized as a light image. A difference between a potential in a portion where the ghost appears upon application of a halftone potential and the halftone potential is called as a ghost potential, and the smaller the ghost potential, the less the ghost appears.

A reason why these occur is possibly that the charge is trapped in the film for some reason in the process of carrying out charging or decharging. Attempts have been made to decrease the potential shift and ghost potential by various methods, but the technology capable of achieving a further improvement is desired earnestly.

SUMMARY OF THE INVENTION

An object of the present invention is to provide a photosensitive member for electrophotography that can obtain high-quality images free of the image faintness and the image smearing without provision of heating means of photosensitive member and that has high durability enough to maintain the characteristics, and a fabrication process thereof. Another object of the present invention is to provide a photosensitive member for electrophotography that can realize prevention of fusion of low-melting-point toner such as color toner and prevention of density nonuniformity occurring at rotation cycles of developer carrying member, without use of heating means, and a fabrication process thereof.

Still another object of the present invention is to provide a photosensitive member for electrophotography that experiences less variation in the potential characteristics, that can obtain high-quality images without secular change on a stable basis, and that is free of the ghost phenomenon, and a fabrication process thereof.

A further object of the present invention is to provide an electrophotographic, photosensitive member, which has a photoconductive layer comprised of a non-monocrystal material comprising the matrix of silicon atoms on an electrically conductive substrate, in which a surface layer is comprised of non-monocrystal carbon containing at least hydrogen, and in which the surface layer has a surface containing fluorine, wherein the surface roughness Rz with a reference length being 5 $\mu$m is less than 1000 Å and wherein fluorine contained in the surface layer is present substantially in a region within 50 Å from the surface and a concentration of fluorine to carbon in the region is 20% or more.

Still another object of the present invention is to provide a fabrication process of electrophotographic, photosensitive member comprising, by use of a plasma processing apparatus for generating a plasma between a cathode electrode to which a high-frequency power is applied and an electrically conductive substrate opposed to the cathode electrode in a reaction vessel the pressure in which is capable of being reduced and thereby plasma-processing the substrate, depositing a photoconductive layer comprised of a non-monocrystal material comprising the matrix of silicon atoms on the substrate to be processed, providing a surface layer comprised of non-monocrystal carbon containing at least hydrogen on the photoconductive layer with using at least a hydrocarbon-based gas as a source gas, and etching a surface of the surface layer in a plasma resulting from decomposition of a gas containing at least fluorine atoms to fluorinate the surface, wherein the surface roughness Rz, produced by the etching in the surface, is controlled to be less than 1000 Å when a reference length is 5 $\mu$m and wherein the fluorine contained in the surface layer is made present substantially in a region within 50 Å from the surface and a concentration of fluorine to carbon in the region is controlled to 20% or more.

In addition, the electrophotographic, photosensitive member and the fabrication process thereof purposed by the present invention are achieved in such a way as to comprise, by use of a plasma processing apparatus for generating a plasma between a cathode electrode to which a high-frequency power is applied and an electrically conductive substrate opposed to the cathode electrode in a reaction vessel the pressure in which is capable of being reduced and thereby plasma-processing the substrate, depositing a photoconductive layer comprised of a non-monocrystal material comprising the matrix of silicon atoms on the substrate to be processed, providing a surface layer comprised of non-monocrystal carbon containing at least hydrogen on the photoconductive layer with using at least a hydrocarbon-based gas as a source gas, and etching a surface of the surface layer in a plasma resulting from decomposition of a gas containing at least fluorine atoms to fluorinate the surface, wherein the surface roughness Rz, produced by the etching in the surface, is controlled to be less than 1000 Å when a reference length is 5 $\mu$m and wherein the fluorine contained in the surface layer is made present substantially in a region within 50 Å from the surface and a concentration of fluorine to carbon in the region is controlled to 20% or more.

The inventors first focused attention on the configuration of the surface of fluorinated, non-monocrystal carbon film as a method for maintaining high water repellency. The method for controlling water repellency by providing the surface with uneven configuration is disclosed in the bulletin of Japanese Patent Application Laid-Open No. 64-84257 as described previously, but the sheet-pass durability tests confirmed that the surface by this method was shaved gradually to result in showing no effect of unevenness. Thus, further tests were conducted with changing unevenness of surface by various methods from the starting point of the high-hardness surface layer that is not shaved, i.e., the surface layer based on the etching of non-monocrystal carbon not containing fluorine by the fluorine plasma as disclosed in the bulletin of Japanese Patent Application Laid-Open No. 61-289354.

Since it was contemplated that fluorination and change of surface configuration occurred upon etching of surface by the fluorine plasma, tests were conducted in combinations of production of non-monocrystal carbon film with etching by fluorine-based gas under various conditions. The tests clarified that the initial water repellency was able to be maintained for a long period under certain limited conditions.

Then the inventors examined samples of different surface configurations etched by the fluorine plasma in detail by use of an atomic force microscope (AFM), for further observing detailed configurations of surface. As the result of this examination, it was found that the surface of a photosensitive member with low durability was a very rough surface in the atomic level and, inversely, that a photosensitive member with relatively high durability had a surface with high flatness. Specifically, the inventors investigated in further detail changes in durability concerning the image smearing using surface roughness as an index and found that durability greatly changed at the border of about 1000 Å of ten-point average roughness (Rz) in the field 5 $\mu$m square. When etching was conducted under such hard conditions that Rz became over 1000 Å, for example, at extremely large etching rates far greater than 100 A/sec, the configuration of surface changed greatly, thereby forming very rough surfaces and greatly degrading the durability concerning the image smearing.

On the other hand, it was found that when etching was carried out under such conditions that Rz was controlled to below 1000 Å, the surface configuration was comprised of gently curved surfaces, the durability as to the image smearing was improved greatly, and there was such a tendency that the less the unevenness of surface, the longer the image run characteristics were able to be kept. It is considered that this fact was not clarified heretofore, because such fine unevenness was hard to measure by ordinary surface roughness measuring devices and was not observed clearly without use of high-resolution measuring means such as the AFM.

In the case of such very flat surfaces, the water repellency thereof is improved as compared with the conventional surface layers, but is slightly lower than that of the surface layer with unevenness. However, the flatter the surface, the higher the durability for maintaining the high water repellency. The reason of this is not clear yet, but may be considered as follows.

When the surface has unevenness, the surface area is increased to enhance the effect of fluorine, which improves the water repellency. In carrying out actual copying operations, however, the surface is rubbed by various members and paper, so that force is concentrated on projections, where rubbing conditions are considered to become severer.

It is conceivable that when such concentration of force continues for a long period, fluorine or carbon coupled with fluorine near the outermost surface becomes easier to leave even in the case of the high-hardness film hard to shave. The inventors actually checked the surface layer after a large number of copies, and the results showed that no change was observed in the thickness of film when measured by optical means, but a decrease was seen in fluorine content. The reason of this is possibly that fluorine near the outermost surface dropped out.

In contrast with it, in the case of the surface being flat, no concentration of force occurs and water repellency is thus considered to be maintained even in use of long term. Normally, flatter surfaces show worse smoothness and abrasion characteristics thereof are often degraded; whereas, in the case of the present invention, the effect of fluorine prevents the slip property from being degraded and rather improves the slip property as compared with the ordinary electrophotographic, photosensitive members, thus achieving the effect of no occurrence of poor cleaning.

Next, the inventors conducted investigation on amounts of fluorine near the surface.

Tests were conducted as keeping Rz almost equal and as changing the etching conditions so as to change the concentration of fluorine. When fluorine contained was less than 20%, the initial water repellency was low and the image smearing preventing effect was not sufficient. It was, however, found that when the surface contained 20% or more of fluorine, the water repellency was maintained even after a large number of copying operations. Another effect observed was an improvement in transfer efficiency due to an improvement in releasability. It was thus found that fluorine was preferably diffused in the concentration of 20% or more with respect to carbon.

On the other hand, it was clarified as an unexpected effect of the present invention that, as to the depth of diffusion of fluorine, the potential characteristics change greatly around 50 Å. Particularly, the potential shift and ghost level tended to be improved greatly when the etching conditions by the fluorine plasma were controlled so that a region of distribution of fluorine atoms was within approximately 50 Å from the outermost surface. The reason why the potential characteristics were improved only under such conditions as to keep the fluorine atoms present substantially within 50 Å is possibly that strong covalent bonds between fluorine and carbon were formed in the outermost surface of the surface layer so as to make the film more dense, thereby suppressing injection of electrification charge, and decreasing trap of carrier. Further, it is presumed that, by keeping the depth of existence of fluorine atoms within 50 Å, desorption can be minimized of hydrogen atoms upon introduction of fluorine atoms and the above improvement is achieved by a superb balance between them.

These clarified that diffusion of fluorine should be desirably in the range of 50 Å (within a layer of several atoms to ten and several atoms) and that fluorine should be diffused preferably in the concentration of 20% or more to carbon.

DETAILED DESCRIPTION OF THE PREFERRED EMBODIMENTS

The present invention will be described in detail with reference to the drawings.

Figure 1A:
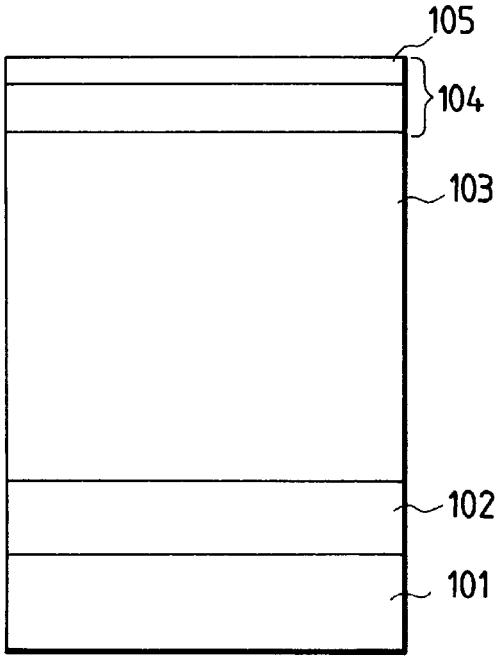
FIG. 1A and FIG. 1B are schematic, cross-sectional views, each showing an example of layer structure of the photosensitive member for electrophotography.
Figure 1B:
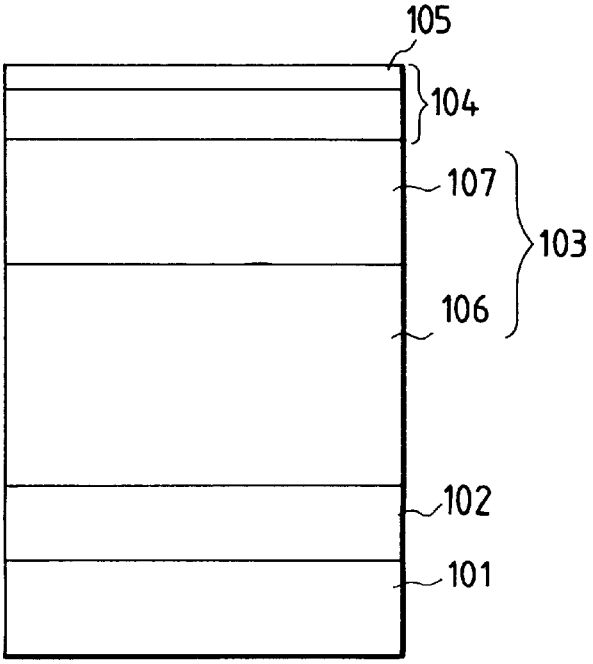

FIGS. 1A and 1B are schematic, cross-sectional views each of which is for explaining an example of layer structure of the electrophotographic, photosensitive member according to the present invention. FIG. 1A shows a photosensitive member called as a single layer type where the photoconductive layer is not functionally separated, which is a photosensitive member having a stack of a charge injection preventing layer 102, a photoconductive layer 103 comprised of a-Si containing at least hydrogen, and a surface layer 104 comprised of non-monocrystal carbon on a substrate 101. Reference numeral 105 represents a region where fluorine is diffused, existing in the outermost surface of the surface layer.

FIG. 1B shows a photosensitive member called a function separate type, because the photoconductive layer is functionally separated into two, a charge generating layer and a charge transport layer. The charge injection preventing layer 102 is provided, if necessary, on the substrate 101, and the photoconductive layer 103 comprised of a-Si containing at least hydrogen, functionally separated into the charge transport layer 106 and charge generating layer 107, is deposited on the charge injection preventing layer 102. Then the surface layer 104 of non-monocrystal carbon is stacked on the photoconductive layer 103. Here, any positional relation can be adopted between the charge transport layer 106 and the charge generating layer 107. In the case of the functional separation being made by change in composition, the change in composition may be made continuously.

In the photosensitive members as exemplified in FIG. 1A and FIG. 1B, each layer may involve continuous change in composition and a definite interface does not have to be made between the layers. The charge injection preventing layer 102 may be omitted as occasion demands. An intermediate layer may be provided between the photoconductive layer 103 and the surface layer 104 comprised of non-monocrystal carbon, if necessary, for the purpose of enhancement of adhesion or the like. An example of the material for the intermediate layer is SiC having an intermediate composition between the photoconductive layer 103 and the surface layer 104 or may be SiO or SiN. The intermediate layer may be made with continuously changing compositions.

The "non-monocrystal carbon" stated herein mainly represents amorphous carbon having intermediate properties between graphite and diamond, and it may partly contain microcrystals or polycrystals. This can be produced by the plasma enhanced CVD process, the sputtering process, the ion plating process, or the like, and a film produced by the plasma enhanced CVD process is preferable for use as a surface layer of an electrophotographic, photosensitive member, because it has high transparency and high hardness.

Any frequency can be used as a discharge frequency in the plasma enhanced CVD process for producing the non-monocrystal carbon film. Industrially, the high frequencies of 1 to 450 MHz called the RF frequency band, especially, the high frequency of 13.56 MHz, can be used suitably. Especially, when the high frequency is selected from the frequency band called VHF of 50 to 450 MHz, the transparency and hardness can be enhanced further, so that a resultant film is more preferable for use as a surface layer.

Fluorine-based gases used for achieving the effects of the present invention can be any gases that can generate active fluorine radicals in formation of plasma, such as $CF_4$, $CHF_3$, $CH_2F_2$, $CH_3F$, $C_2F_6$, $C_2F_4$, $CH_2CF_2$, $ClF_3$, $SF_6$, HF, or $F_2$. Mixtures of these gases or these gases diluted with another gas such as the rare gases can also be adopted.

Figure 2:
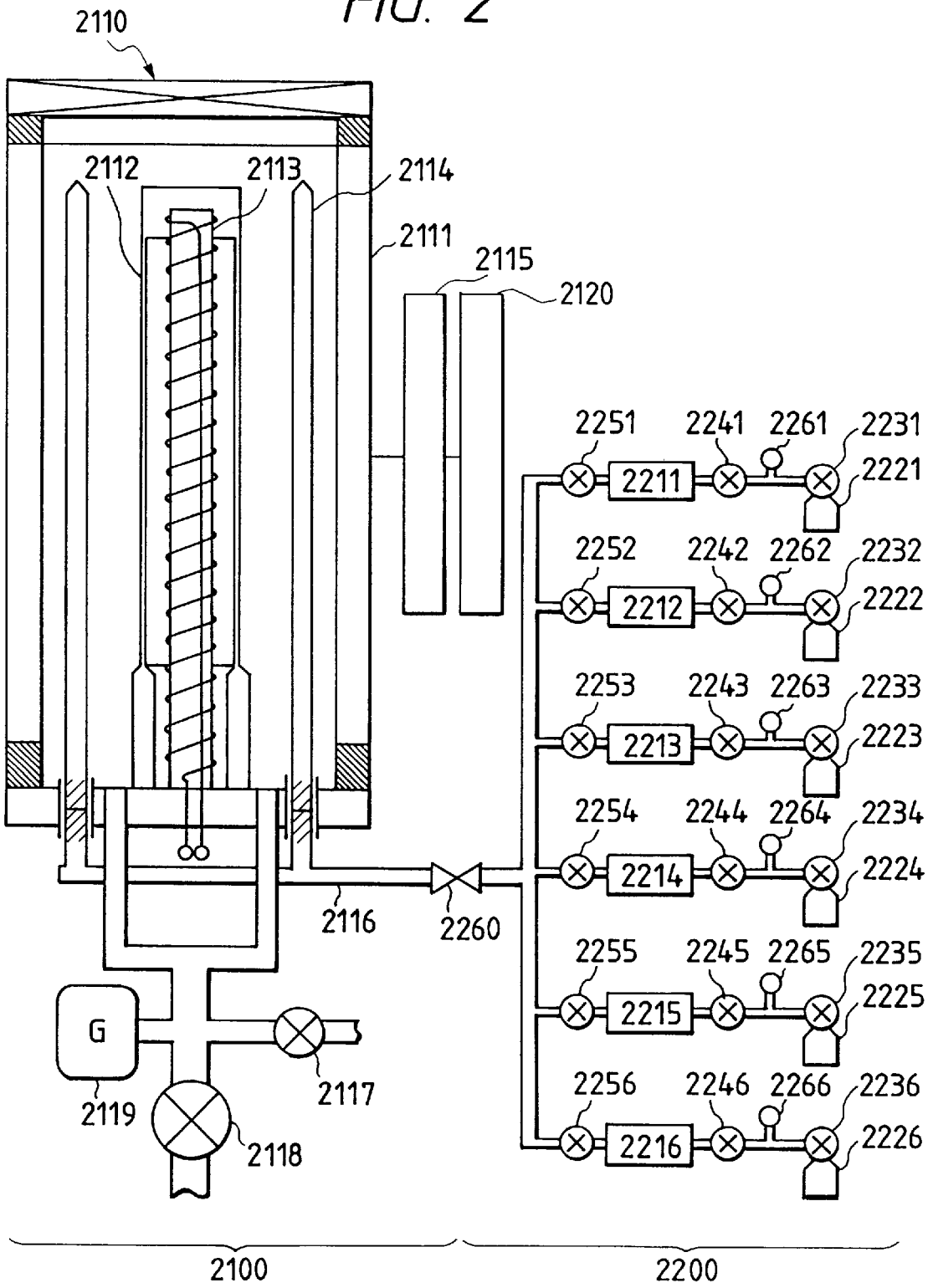
FIG. 2 is a schematic, structural view to show an example of depositing apparatus for forming the photosensitive member.

FIG. 2 is a view to schematically show an example of the depositing apparatus of photosensitive member by the plasma enhanced CVD process by use of a high-frequency power supply according to the present invention.

This apparatus is roughly composed of a depositing apparatus 2100, a source gas supplying apparatus 2200, and an evacuating apparatus (not illustrated) for reducing the pressure inside reaction vessel 2110. Disposed inside the reaction vessel 2110 in the depositing apparatus 2100 are cylindrical deposition-target substrate 2112 connected to the earth, heater 2113 for heating the cylindrical deposition-target substrate, and gas inlet pipes 2114, and high frequency power supply 2120 is connected through RF matching box 2115 to the reaction vessel.

The source gas supplying apparatus 2200 is composed of source gas bombs and etching gas bomb 2221 to 2226 of $SiH_4$, $H_2$, $CH_4$, NO, $B_2H_6$, $CF_4$, and the like, valves 2231 to 2236, 2241 to 2246, 2251 to 2256, and mass flow controllers 2211 to 2216, and each bomb of component gas is connected through valve 2260 to the gas inlet pipes 2114 in the reaction vessel 2110.

The high frequency power supply used in the present invention may be of any output as long as it can generate the power suitable for the apparatus used in the range of 10 to 5000 W or more. Further, the effects of the present invention can be achieved with any values of output change rate of the high frequency power supply.

The matching box 2115 suitably applicable may be selected from those of any types that can match the load with the high frequency power supply 2120. A method of matching is preferably of automatic control, but a matching method of manual control can also be applied without affecting the effects of the present invention.

The material for the cathode electrode 2111 to which the high frequency power is applied is selected from copper, aluminum, gold, silver, platinum, lead, nickel, cobalt, iron, chromium, molybdenum, titanium, stainless steel, and composite materials containing two or more of these materials. A preferred shape is a cylinder, but it may be oval or polygonal in a cross section as occasion may demand.

The cathode electrode 2111 may be provided with a cooling device with necessity. Specific examples of the cooling device include cooling by water, air, liquid nitrogen, Peltier element, or the like, which is selected depending upon the purpose.

The deposition-target substrate 2112 used in the present invention is shown to be cylindrical in FIG. 2 but may be of any material and any shape according to the application purpose. For example, the shape is desirably cylindrical in the case of application to the photosensitive member for electrophotography, but the shape may be of a flat plate or any other shape as occasion may demand. The material for the substrate is selected from copper, aluminum, gold, silver, platinum, lead, nickel, cobalt, iron, chromium, molybdenum, titanium, stainless steel, and composite materials containing two or more of these materials, and also from structures having an electroconductive material coating over an insulating material such as polyester, polyethylene, polycarbonate, cellulose acetate, polypropylene, polyvinyl chloride, polyvinylidene chloride, polystyrene, glass, quartz, ceramics, or paper.

As for the configuration of surface, unevenness with relatively large cycles, obtained by cutting with cutting tool, dimple processing, or the like, can be additionally made for the purpose of prevention of interference or the like, because it does not degrade the durability as to the image faintness under high temperature and high humidity circumstances. When the roughness of the outermost surface of the electrophotographic, photosensitive member is measured with respect to the reference length of 5 $\mu$m, the effects of the present invention can be achieved if Rz is less than 1000 Å. Since the roughness of surface can be flattened by etching by the fluorine plasma after deposition of the photosensitive member, the present invention is not so sensitive as to the roughness of surface of a substrate before formation of a film.

An example of procedures in the method for forming the photosensitive member by use of the apparatus of FIG. 2 will be described. The cylindrical deposition-target substrate 2112 is set inside the reaction vessel 2110 and the inside of the reaction vessel 2110 is evacuated by the evacuation device (for example, a vacuum pump) not illustrated. Subsequently, the temperature of the cylindrical deposition-target substrate 2112 is controlled at the predetermined temperature in the range of 20° C. to 500° C. by the heater 2113 for heating the cylindrical deposition-target substrate.

For letting the source gases for formation of photosensitive member flow into the reaction vessel 2110, it is first confirmed that the valves 2231 to 2236 of the gas bombs and a leak valve 2117 of the reaction vessel are closed and that the inflow valves 2241 to 2246, the outflow valves 2251 to 2256, and the auxiliary valve 2260 are opened, and thereafter the main valve 2118 is opened to evacuate the reaction vessel 2110 and gas supply pipes 2116.

Next, the auxiliary valve 2260 and outflow valves 2251 to 2256 are closed when reading on a vacuum gage 2219 reaches approximately $5\times10^{-6}$ Torr. After that, each gas is introduced from the gas bomb 2221 to 2226 with opening the valve 2231 to 2236 and the pressure of each gas is adjusted to 2 kg/cm$^2$ by a pressure regulator 2261 to 2266. Next, the inflow valve 2241 to 2246 is opened gradually to introduce each gas into the mass flow controller 2211 to 2216.

After completion of preparation for film formation by the above procedures, the photoconductive layer is made on the cylindrical deposition-target substrate 2112.

When the cylindrical deposition-target substrate 2112 reaches the predetermined temperature, the auxiliary valve 2260 and necessary valves out of the outflow valves 2251 to 2256 are opened gradually to introduce predetermined source gases from the respective gas bombs 2221 to 2226 through the gas inlet pipes 2114 into the reaction vessel 2110. Then the flow rate of each source gas is adjusted to the predetermined flow rate by the mass flow controller 2211 to 2216. On that occasion, opening of the main valve 2118 is adjusted as observing the vacuum gage 2119 so that the inside of the reaction vessel 2110 may be kept at the predetermined pressure of not more than 1 Torr.

When the internal pressure becomes stable, the high frequency power supply 2120 is set to desired power to supply it through the RF matching box 2115 to the cathode electrode 2111, thereby inducing RF glow discharge. This discharge energy decomposes the source gases introduced into the reaction vessel 2110, whereby a desired deposited film containing the main ingredient of silicon atoms is made on the cylindrical deposition-target substrate 2112. After the deposited film is made in a desired film thickness, the supply of high frequency power is stopped, and the outflow valves 2251 to 2256 are closed to stop the flow of each source gas into the reaction vessel 2110, thus ending the fabrication of deposited film.

The surface layer of the present invention can also be made basically by repeating the above operations and supplying the film-forming gases and etching gas.

Specifically, necessary valves out of the outflow valves 2251 to 2256 and the auxiliary valve 2260 are opened gradually to introduce source gases necessary for the surface layer from the gas bombs 2221 to 2226 through the gas inlet pipes 2114 into the reaction vessel 2110. Then each mass flow controller 2211 to 2216 is adjusted so as to keep each source gas at a predetermined flow rate. On that occasion, the opening of the main valve 2118 is adjusted as observing the vacuum gage 2119 so as to keep the inside of the reaction vessel 2110 at the predetermined pressure of not more than 1 Torr.

When the internal pressure becomes stable, the high frequency power supply 2120 is set at desired power to supply the high frequency power through the RF matching box 2115 to the cathode electrode 2111, thereby inducing the RF glow discharge. This discharge energy decomposes each source gas introduced into the reaction vessel 2110 and the surface layer is made thereby. After the film is made in the desired thickness, the supply of high frequency power is stopped, and each outflow valve 2251 to 2256 is closed to stop the flow of each source gas into the reaction vessel 2110, thus ending the formation of surface layer.

After the gases used for the formation of film are exhausted sufficiently from the inside of the reaction vessel, a necessary valve out of the outflow valves 2251 to 2256 and the auxiliary valve 2260 are opened gradually to introduce a gas containing at least fluorine atoms, necessary for the etching process, from the gas bomb 2221 to 2226 through the gas inlet pipes 2114 into the reaction vessel 2110. Next, the mass flow controller 2211 to 2216 is adjusted so as to keep the gas containing fluorine atoms at a predetermined flow rate. On that occasion, the opening of the main valve 2118 is adjusted as observing the vacuum gage 2119 so as to keep the inside of the reaction vessel 2110 at the predetermined pressure of not more than 1 Torr.

When the internal pressure becomes stable, the high frequency power supply 2120 is set at desired power to supply the high frequency power through the RF matching box 2115 to the cathode electrode 2111, thus inducing the RF glow discharge. The gas containing fluorine atoms, introduced into the reaction vessel 2110 is decomposed by this discharge energy to react with the surface layer, thus performing the etching process of the surface layer.

Since the control of the surface configuration and the depth of a region containing fluorine atoms can be set arbitrarily by changing the internal pressure, the high frequency power, the temperature of a substrate, or the like, they can be determined under desired conditions. After completion of the etching process in the desired thickness of film, the supply of high frequency power is stopped and each outflow valve 2251 to 2256 is closed to stop the flow of source gases to the reaction vessel 2110. During the formation of film the cylindrical deposition-target substrate 2112 may be rotated at predetermined speed by a driving device (not illustrated).

Figure 3:
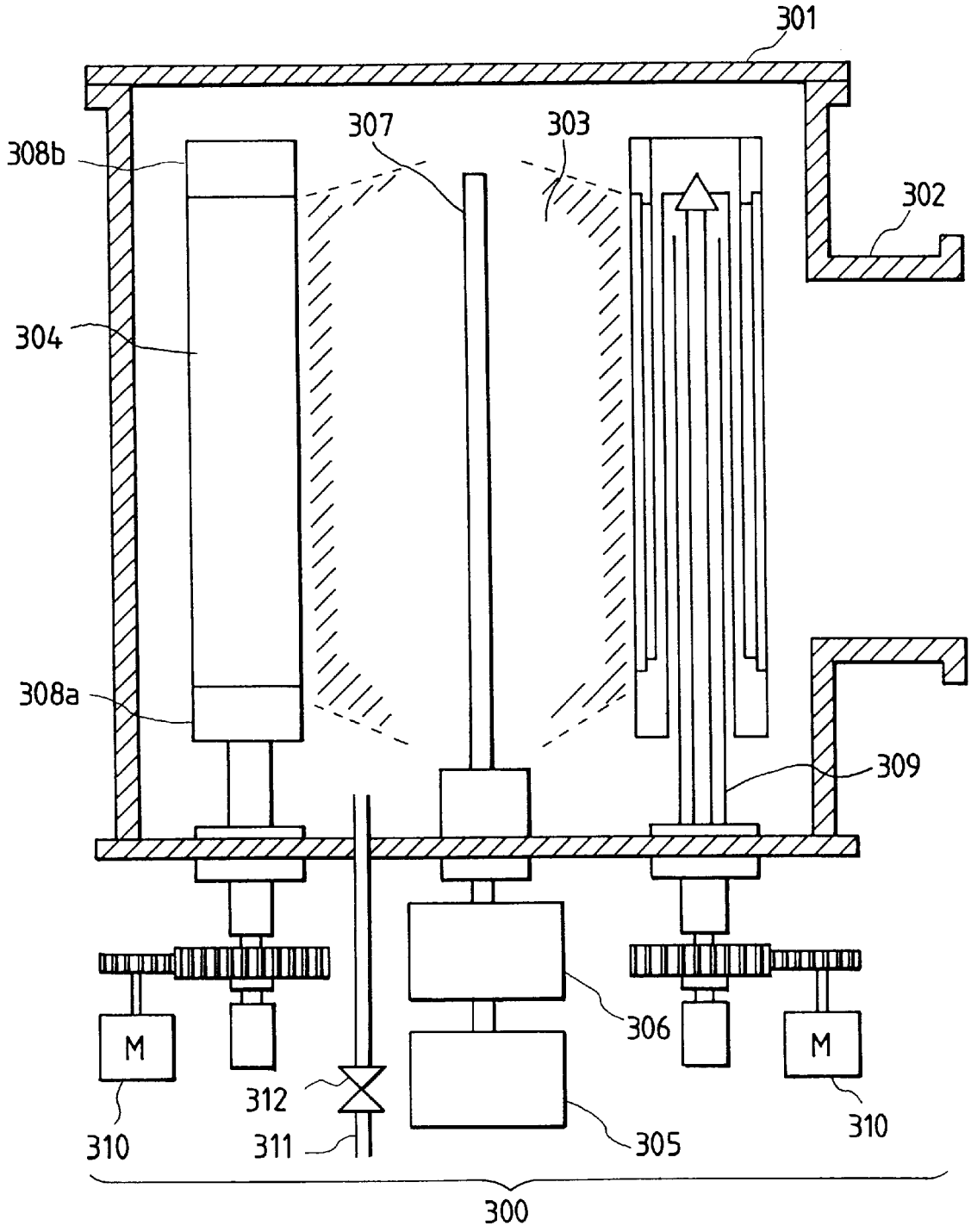
FIG. 3 is a schematic, structural view to show an example of depositing apparatus for forming the photosensitive member by a VHF-PCVD process.

FIG. 3 is a schematic diagram to show an example of an apparatus (of mass production type) for forming the electrophotographic, photosensitive member by the plasma enhanced CVD process in a form different from FIG. 2 described above. FIG. 3 illustrates a cross-sectional view of the reaction vessel part 300 of the apparatus.

In FIG. 3 reference numeral 301 designates the reaction vessel, which is constructed in vacuum airtight structure. Reference numeral 302 denotes an exhaust pipe one end of which is open in the reaction vessel 301 and the other end of which is in communication with an evacuating device (not illustrated). Reference numeral 303 represents a discharge space surrounded by cylindrical deposition-target substrates 304. High frequency power supply 305 is electrically connected through RF matching box 306 to electrode 307. Each cylindrical deposition-target substrate 304 is mounted on rotary shaft 309 as being set on holder 308*a* and 308*b*. Each cylindrical deposition-target substrate 304 is arranged to be rotated by motor 310 with necessity.

The source gas supplying device (not illustrated) may be the same as that 2200 shown in FIG. 2. Component gases are mixed and are introduced through valve 312 to gas inlet pipe 311 in the reaction vessel 301.

The high frequency power supply of this forming apparatus used in the present invention may be of any output as long as it can generate the power suitable for the apparatus used in the range of 10 to 5000 W or more. Further, the effects of the present invention can be achieved with any values of output change rate of the high frequency power supply.

The matching box 306 suitably applicable may be selected from those of any types that can match the load with the high frequency power supply 305. A method of matching is preferably of automatic control, but a matching method of manual control can also be applied without affecting the effects of the present invention.

The material for the electrode 307 to which the high frequency power is applied is selected from copper, aluminum, gold, silver, platinum, lead, nickel, cobalt, iron, chromium, molybdenum, titanium, stainless steel, and composite materials containing two or more of these materials. A preferred shape is a cylinder, but it may be oval or polygonal in a cross section as occasion may demand.

The electrode 307 may be provided with a cooling device with necessity. Specific examples of the cooling device include cooling by water, air, liquid nitrogen, Peltier element, or the like, which is selected depending upon the purpose.

The deposition-target substrate 304 used in the present invention is shown to be cylindrical but may be of any material and any shape according to the application purpose. For example, the shape is desirably cylindrical in the case of application to the photosensitive member for electrophotography, but the shape may be of a flat plate or any other shape as occasion may demand. The material for the substrate is selected from copper, aluminum, gold, silver, platinum, lead, nickel, cobalt, iron, chromium, molybdenum, titanium, stainless steel, and composite materials containing two or more of these materials, and also from structures having an electroconductive material coating over an insulating material such as polyester, polyethylene, polycarbonate, cellulose acetate, polypropylene, polyvinyl chloride, polyvinylidene chloride, polystyrene, glass, quartz, ceramics, or paper.

Figure 4:
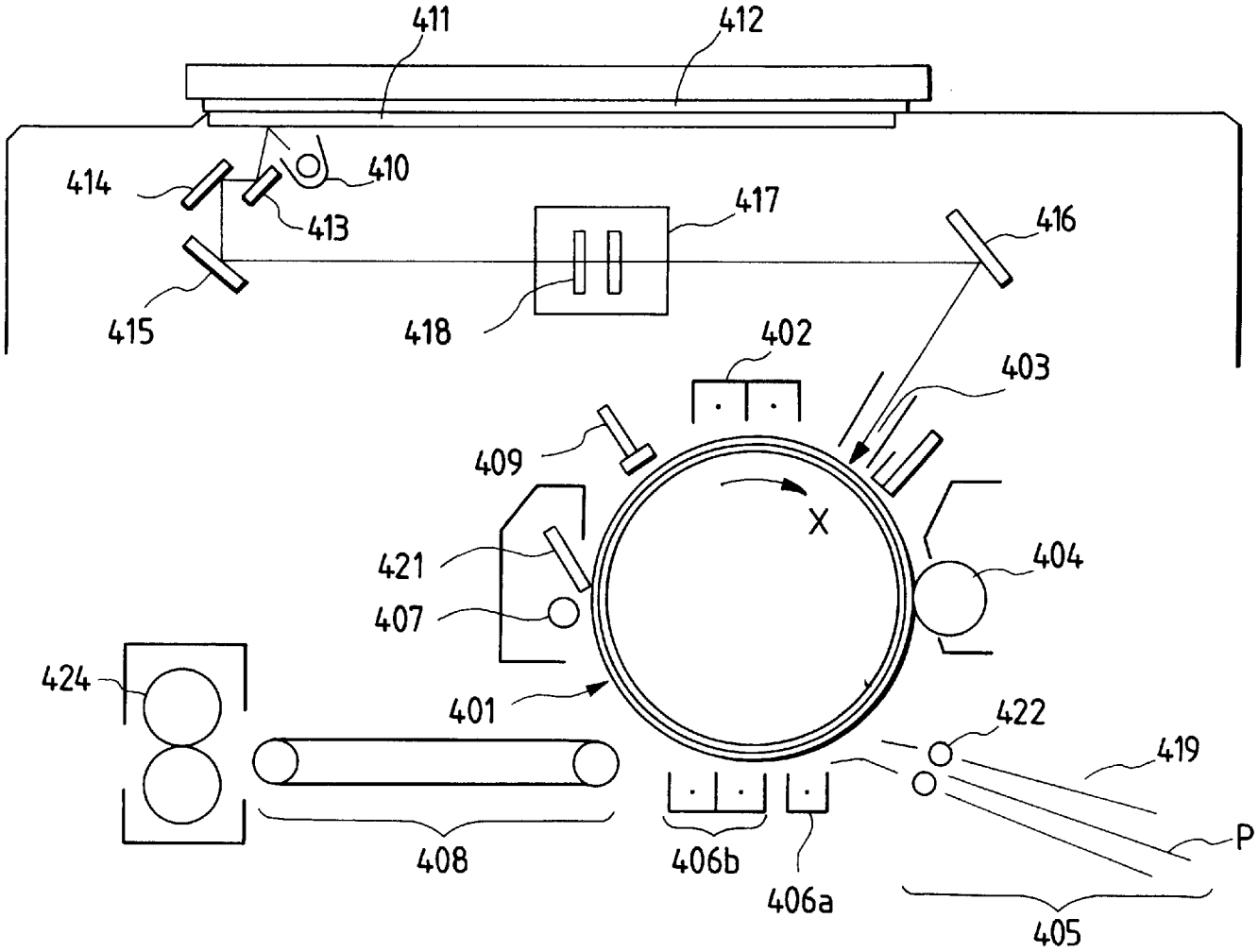
FIG. 4 is a schematic, cross-sectional, structural view for explaining an example of electrophotographic apparatus.

FIG. 4 is a schematic, cross-sectional, structural view of an electrophotographic apparatus to show an example of the image forming process of an electrophotographic apparatus. The photosensitive member 401 rotates in the direction of arrow X. In the peripheral region of the photosensitive member 401 there are a primary charger 402, an electrostatic latent image forming section 403, a developing device 404, a transfer sheet supply system 405, a transfer charger 406*a*, a separation charger 406*b*, a conveying system 408, a cleaner 407, a charge-eliminating light source 409, and so on disposed clockwise around the photosensitive member 401.

The image forming process will be described in further detail. The photosensitive member 401 is uniformly charged by the primary charger 402 to which a high voltage is applied. In the electrostatic latent image forming section, an electrostatic latent image is formed on the photosensitive member 401. Specifically, a light emitted from lamp 410 is reflected by an original 412 placed on an original glass platen 411, the reflected light is guided via mirrors 413, 414, 415 to be focused by lenses 418 of a lens unit 417, and the light is guided via a mirror 416 to be projected onto the photosensitive member, thus forming the electrostatic latent image. Negative toner is supplied from the developing device 404 to this latent image, thereby forming a toner image.

On the other hand, a transfer sheet P is supplied through a paper feeding guide 419 in the transfer sheet supply system 405 toward the photosensitive member 401 with its tip timing being adjusted by registration rollers 422. The transfer sheet P is given a positive electric field of the opposite polarity to the toner from the back in the gap between the transfer charger 406*a* to which a high voltage is applied, and the photosensitive member 401. This causes the toner image of the negative polarity on the surface of the photosensitive member to be transferred onto the transfer sheet P. Then the transfer sheet P is separated by the separation charger 406*b* to which high AC voltage is applied, the transfer sheet P is conveyed through the transfer sheet conveying system 408 to a fixing device 424, the toner image is fixed thereby, and the transfer sheet is discharged to the outside of the apparatus.

The toner remaining on the photosensitive member 401 is collected by a magnet roller 407 of the cleaning unit 407, and a cleaning blade 421, and the electrostatic latent image still remaining on the photosensitive member is eliminated by the charge-eliminating light source 409.

EXAMPLES

The present invention will be described specifically with examples, but it is noted that the present invention is by no means intended to be limited to the examples.

Example 1

The deposited film was formed by successive stacking on a cylindrical Al substrate by use of the plasma enhanced CVD system illustrated in FIG. 2 and under the conditions shown in Table 1. Three photosensitive members were made in this way. Then etching was conducted under the conditions shown in Table 2 with changing high frequency power, thereby making three types of photosensitive members, one having such a surface after etching that Rz was approximately 200 Å, another having such a surface of after etching that Rz was approximately 500 Å, and the other having such a surface after etching that Rz was approximately 800 Å. It is known that with the power in this range the depth of penetration of fluorine is 20 Å or so and that the concentration thereof is 30 to 40%.

TABLE 1

(Fabrication conditions of photosensitive member)

| | |
|---|---|
| Lower preventing layer | $SiH_4$: 260 sccm<br>$H_2$: 500 sccm<br>NO: 7 sccm<br>$B_2H_6$: 2100 ppm<br>power: 110 W<br>internal pressure: 0.42 Torr<br>thickness: 1.5 $\mu$m |
| Photoconductive layer | $SiH_4$: 510 sccm<br>$H_2$: 450 sccm<br>power: 450 W<br>internal pressure: 0.55 Torr<br>thickness: 20 $\mu$m |
| Surface layer | $CH_4$: 200 sccm<br>power: 1000 W<br>internal pressure: 0.4 Torr<br>thickness: 0.3 $\mu$m |

TABLE 2

(Conditions of etching by fluorine plasma)

| |
|---|
| $CF_4$: 400 sccm<br>Temperature of substrate: 200° C.<br>Pressure: 0.4 Torr |

For evaluating the water repellency of the above photosensitive members, the contact angle of surface was measured with pure water by a contact angle meter (CA-S-roll type) available from Kyowa Kaimen Kagaku Sha. The three photosensitive members showed contact angles not less than 100°, which confirmed that high water repellency was achieved.

Then the potential characteristics were evaluated. The evaluation was carried out by mounting the photosensitive member on a measuring device as an imitative copier and changes in the surface potential were measured under various conditions. For evaluating the potential shift, while keeping constant electric current flowing to the charger, charging potentials were observed on the surface of photosensitive member for two minutes (equivalent to 100 copies in the case of the copier NP-5060 available from CANON INC.), thus checking changes thereof. As for the ghost potential, it was obtained in such a way that the photosensitive member was electrified, then the photosensitive member was subjected to the same process as the copy process including exposure, charge elimination, and so on, thereafter a halftone potential was given after one cycle, and a difference was observed between exposed part and unexposed part.

Next, the photosensitive member was mounted on a modified model of copier NP-5060 available from CANON INC., modified for test, and 100,000 consecutive copies were conducted without using the heating means such as the drum heater under high temperature and high humidity circumstances of 30° and 80%, thus performing a durability test. On this occasion, the magnet roller was rotated at a higher speed counterclockwise than in normal use as being kept in contact with the photosensitive member, and urging pressure of the cleaning blade was set higher than normal. Thus, the load on the surface by slip abrasion was set to be severer. The copy original used was a test chart available from CANON INC. (part number: FY9-9058).

Evaluation was conducted as to the contact angle and image smearing characteristics before and after the above durability test. The contact angles were evaluated in the same method as described above and the image smearing was evaluated by whether fine lines of the above test chart were blurred or not.

For checking the transfer efficiency, the waste toner was collected after the durability test and the weight thereof was measured accurately to be compared.

As for resistance to flaws, forced jam tests were carried out ten times after the durability test and thereafter a halftone image was formed to check conditions of flaws.

The results of various characteristics obtained by the above evaluations are shown as Ex. 1 in Table 4.

In each evaluation in the table, "⊙" represents "very good," "○" does "good," "Δ" does "no problem for practical use," and "x" does "possibly posing a problem for practical use in some cases."

TABLE 3

(Conditions of etching by fluorine plasma (Example 2, Comparative Example 2))

$CF_4$: 400 sccm
Temperature of substrate: (variable)
Pressure: (variable)
High frequency power: 400 W

TABLE 4

(Changes in characteristics depending on surface roughness (Example 1, Comparative Example 1))

| | Surface roughness Rz [Å] | Characteristics after durability test of 100,000 copies: Contact angle | Potential shift | Ghost | Image smearing | Transfer efficiency | Forced jam test |
|---|---|---|---|---|---|---|---|
| Ex. 1 | 200 | ⊙ | ⊙ | ⊙ | ⊙ | ⊙ | ⊙ |
| | 500 | ⊙ | ⊙ | ⊙ | ⊙ | ⊙ | ⊙ |
| | 800 | ⊙ | ⊙ | ⊙ | ⊙ | ⊙ | ⊙ |
| Comp. Ex. 1 | 1000 | Δ | ⊙ | ⊙ | Δ | ⊙ | ⊙ |
| | 2000 | x | ⊙ | ⊙ | x | ⊙ | ⊙ |

Comparative Example 1

The deposited film was formed by successive stacking on the cylindrical Al substrate by use of the plasma enhanced CVD system illustrated in FIG. 2 and under the conditions shown in Table 1. Two photosensitive members were made in this way. Then etching was conducted under the conditions shown in Table 2 with high frequency power than in Example 1, thereby making two types of photosensitive members, one having such a surface after etching that Rz was approximately 1000 Å and the other having such a surface after etching that Rz was approximately 2000 Å. It is known that in this condition range the depth of penetration of fluorine is 35 Å or so and that the concentration thereof is 40 to 50%.

Next, the same durability test and evaluations as in Example 1 were carried out for each photosensitive member.

The results of changes in characteristics in the above evaluations are shown as Comp. Ex. 1 in Table 4, together with the results of Example 1.

The potential measurements showed that there was no problem in both the potential shift and the ghost potential for all the photosensitive members.

With the photosensitive members of Rz up to 800 Å, no image smearing occurred at all even after the durability test of 100,000 copies. With the photosensitive member of Rz of 1000 Å, images were formed in slightly lowered resolution. With the photosensitive member of Rz of 2000 Å, the image smearing occurred. This is conceivably because the binding condition of surface changed greatly at the border where Rz was 1000 Å, which made fluorine easier to drop out. With the photosensitive members each having the roughness of 1000 or 2000 Å, giving rise to the image smearing, the contact angle after the durability test of 100,000 copies was degraded to 45° or 35°, respectively. Since the forced jam tests resulted in observing no occurrence of flaws or the like in either one of the photosensitive members, it was confirmed that the hardness of surface layer was sufficient.

Example 2

The deposited film was formed by successive stacking on the cylindrical Al substrate by use of the plasma enhanced CVD system illustrated in FIG. 2 and under the conditions shown in Table 1. Three photosensitive members were made in this way. Then etching was carried out under the conditions shown in Table 3 and depths of penetration of fluorine were changed to 5, 25, and 50 Å by changing the temperature and pressure of reaction. The surface roughness by etching was controlled to be approximately 500 Å.

Fluorine contents to carbon in the surface layer were measured for the three photosensitive members by XPS (x-ray photoelectron spectroscopy) and the fluorine contents were 22, 37, and 45%, respectively.

Next, the same durability test and evaluations as in Example 1 were carried out for each photosensitive member.

The results of characteristics obtained are shown as Ex. 2 in Table 5.

TABLE 5

(Changes in characteristics depending on change in penetration depth and concentration of fluorine (Example 2, Comparative Example 2))

| | Penetration depth of fluorine [Å] | Concentration of fluorine [%] | Characteristics after durability test of 100,000 copies: Contact angle | Potential shift | Ghost | Image smearing | Transfer efficiency | Forced jam test |
|---|---|---|---|---|---|---|---|---|
| Ex. 2 | 5 | 22 | ○ | ⊙ | ⊙ | ○ | ○ | ⊙ |
| | 25 | 37 | ⊙ | ⊙ | ⊙ | ⊙ | ⊙ | ⊙ |
| | 50 | 45 | ⊙ | ○ | ○ | ⊙ | ⊙ | ⊙ |
| Comp. Ex. 2 | 5 | 15 | x | ⊙ | ⊙ | x | Δ | ⊙ |
| | 55 | 46 | ⊙ | Δ | Δ | ⊙ | ⊙ | ⊙ |
| | 70 | 55 | ⊙ | Δ | Δ | ⊙ | ⊙ | ⊙ |

Comparative Example 2

The deposited film was formed by successive stacking on the cylindrical Al substrate by use of the plasma enhanced CVD system illustrated in FIG. 2 and under the conditions shown in Table 1. Three photosensitive members were made in this way. Then etching was carried out under the conditions shown in Table 3 and depths of penetration of fluorine were changed to 5, 55, and 70 Å by changing the temperature and pressure of reaction. The surface roughness by etching was controlled to be approximately 500 Å.

Fluorine contents to carbon in the surface layer were measured for the three photosensitive members by XPS and the fluorine contents were 15, 46, and 55%, respectively.

Next, the same durability test and evaluations as in Example 1 were carried out for each photosensitive member.

The results of characteristics obtained are shown as Copm. EX. 2 in Table 5, together with the results of Example 2.

From the results of Example 2 and Comparative Example 2, it is seen that the water repellency after the durability test is lowered when the fluorine content is smaller than 20%, even if the depth of penetration is equal at 5 Å. With the lowering of water repellency the image smearing, though a little, occurred. It was also found that when the fluorine content was 20% or more, the transfer efficiency was further increased because of an improvement in releasability, as compared with the photosensitive member with the fluorine content below 20%.

On the other hand, it was also confirmed that in the fluorine content range larger than 20%, when comparison was made between where the depth of penetration was over 50 Å and where the depth of penetration was kept within 50 Å, the potential shift and ghost potential both were improved further when the depth of penetration was kept within 50 Å. These results confirmed that the depth of penetration of fluorine should be within 50 Å and that the fluorine content to carbon should be 20% or more.

Example 3

The deposited film was formed by successive stacking on the cylindrical Al substrate by use of the plasma enhanced CVD system illustrated in FIG. 2 and under the conditions shown in Table 1. Five photosensitive members were made in this way. Then etching was carried out under the conditions shown in Table 2. On this occasion etching was conducted for different etch times, so that etching thicknesses of film were 20, 100, 500, 2000, and 2900 Å, respectively. Since the film thickness of the surface layer was 3000 Å, the thicknesses of film after etching were thus 2980, 2900, 2500, 1000, and 100, respectively. Next, the same durability test and evaluations as in Example 1 were carried out for each photosensitive member.

The results of obtained characteristics such as image smearing are shown as EX. 3 in Table 6.

TABLE 6

(Changes in characteristics depending on etch thickness of film (Example 3, Comparative Example 3))

| | Etch thickness of film [Å] | Thickness of film after etching [Å] | Characteristics after durability test of 100,000 copies: Contact angle | Potential shift | Ghost | Image smearing | Transfer efficiency | Forced jam test |
|---|---|---|---|---|---|---|---|---|
| Ex. 3 | 20 | 2980 | ◎ | ◎ | ◎ | ◎ | ○ | ◎ |
| | 100 | 2900 | ◎ | ◎ | ◎ | ◎ | ◎ | ◎ |
| | 500 | 2500 | ◎ | ◎ | ◎ | ◎ | ◎ | ◎ |

TABLE 6-continued (Changes in characteristics depending on etch thickness of film (Example 3, Comparative Example 3))

| | Etch thickness of film [Å] | Thickness of film after etching [Å] | Characteristics after durability test of 100,000 copies: Contact angle | Potential shift | Ghost | Image smearing | Transfer efficiency | Forced jam test |
|---|---|---|---|---|---|---|---|---|
| | 2000 | 1000 | ◎ | ◎ | ◎ | ◎ | ◎ | ◎ |
| | 2900 | 100 | ◎ | ◎ | ◎ | ◎ | ◎ | ○ |
| Comp. | 5 | 2995 | x | ◎ | ◎ | x | Δ | ◎ |
| Ex. 2 | 2950 | 50 | ◎ | ◎ | ◎ | ◎ | ◎ | x |

Comparative Example 3

The deposited film was formed by successive stacking on the cylindrical Al substrate by use of the plasma enhanced CVD system illustrated in FIG. 2 and under the conditions shown in Table 1. Two photosensitive members were made in this way. Then etching was carried out under the conditions shown in Table 2. On this occasion etching was conducted for different etch times, so that etching thicknesses of film were 5 and 2950 Å, respectively. Since the film thickness of the surface layer was 3000 Å, the thicknesses of film after etching were 2995 and 50 Å, respectively.

Next, the same durability test and evaluations as in Example 1 were carried out for each photosensitive member.

The results obtained are shown as Comp. Ex. 3 in Table 6, together with the results of Example 3.

When the etch thickness of film is small, the fluorine content is expected to be small. When comparison was made between the photosensitive members where the etch thickness of film was 5 Å and where it was 20 Å, slight image smearing occurred after the durability test with the one of 5 Å, whereas no image smearing occurred with the one of 20 Å. From analysis of drums made under the same conditions, the fluorine content in the surface layer where the etch thickness of film was 5 or 20 Å, was found to be 11 or 28%, respectively. As compared with the photosensitive member where the etch thickness of film was 5 Å, the photosensitive members wherein the etch thickness was 20 Å or more were further improved in the transfer efficiency, because of the improvement in releasability. This confirmed that the etch thickness of film was desirably 20 Å or more.

Inversely, when the etch thickness of film was large, the thickness of remaining film became small, and a flaw became easier to appear. Comparison was made between the photosensitive member wherein the etch thickness of film was 2900 Å (the thickness of remaining film in the surface layer was 100 Å) and the photosensitive member wherein the etch thickness was 2950 Å (the thickness of remaining film was 50 Å). Presence or absence of flaw was checked after the forced jam test. When the thickness of remaining film was 50 Å, flaws were sometimes made on the surface in the forced jam test. In contrast with it, no flaw was observed in the case wherein the thickness of remaining film was 100 Å or more.

From these results, it was found that the thickness of film removed by etching should be at least 20 Å and that the thickness of surface layer remaining in the surface was preferably 100 Å or more.

Example 4

The deposited film was formed by successive stacking on the cylindrical Al substrate by use of the plasma enhanced CVD system illustrated in FIG. 2 and under the conditions shown in Table 1. Six photosensitive members were made in this way. Then etching was conducted using six types of gas species including $CF_4$, $CHF_3$, $C_2F_6$, $CF_2{=}CF_2$, $ClF_3$, and $SF_6$ under the conditions shown in Table 2.

Next, the same durability test and evaluations as in Example 1 were carried out for each photosensitive member.

The results of obtained characteristics such as image smearing are shown in Table 7. From the results, it was found that the effects of the present invention were able to be achieved, independent of the types of the gas containing fluorine used in etching.

TABLE 7

(Changes in characteristics depending on difference in etch gases (Example 4))

| | Characteristics after durability test of 100,000 copies | | | | | |
|---|---|---|---|---|---|---|
| | Contact angle | Potential shift | Ghost | Image smearing | Transfer efficiency | Forced jam test |
| $CF_4$ | ◎ | ◎ | ◎ | ◎ | ◎ | ◎ |
| $CHF_3$ | ◎ | ◎ | ◎ | ◎ | ◎ | ◎ |
| $C_2F_6$ | ◎ | ◎ | ◎ | ◎ | ◎ | ◎ |
| $CF_2{=}CF_2$ | ◎ | ◎ | ◎ | ◎ | ◎ | ◎ |
| $ClF_3$ | ◎ | ◎ | ◎ | ◎ | ◎ | ◎ |
| $SF_6$ | ◎ | ◎ | ◎ | ◎ | ◎ | ◎ |

Example 5

The deposited film was formed by successive stacking on the cylindrical Al substrate by use of the plasma enhanced CVD system illustrated in FIG. 2 and under the conditions shown in Table 1. Four photosensitive members were made in this way. Then etching was carried out under the conditions shown in Table 2 while the etch gas was diluted (in 50%) with either one of four types of gas species including He, Ne, Ar, and $N_2$.

Next, the same durability test and evaluations as in Example 1 were conducted for each photosensitive member.

The results of obtained characteristics such as image smearing are shown in Table 8. From the results, it was found that the effects of the present invention were able to be achieved, independent of the dilution of the gas containing fluorine with the rare gas.

TABLE 8

(Changes in characteristics depending on different dilution gases (Example 5))

| | Characteristics after durability test of 100,000 copies | | | | | |
|---|---|---|---|---|---|---|
| | Contact angle | Potential shift | Ghost | Image smearing | Transfer efficiency | Forced jam test |
| $CF_4$/He (50%) | ◎ | ◎ | ◎ | ◎ | ◎ | ◎ |
| $CF_4$/Ne (50%) | ◎ | ◎ | ◎ | ◎ | ◎ | ◎ |
| $CF_4$/Ar (50%) | ◎ | ◎ | ◎ | ◎ | ◎ | ◎ |
| $CF_4$/$N_2$ (50%) | ◎ | ◎ | ◎ | ◎ | ◎ | ◎ |

Example 6

The deposited film was formed by successive stacking on the cylindrical Al substrate by use of the plasma enhanced CVD system illustrated in FIG. 2 and under the conditions shown in Table 1. Then etching was carried out under the conditions shown in Table 2 to effect fluorination. It is known that under the conditions, Rz is 500 Å, fluorine is diffused within about 20 Å, and fluorine is contained in about 40% in the pertinent region.

Next, this photosensitive member was mounted on the modified model of copier NP-5060 available from CANON INC. and the durability test of 500,000 copies was conducted in the same manner as in Example 1. However, the surface of the drum was maintained at about 50° C. by use of a heating device of the drum. The results are shown in Table 9.

TABLE 9

(Comparison of fusion etc. with heating by drum heater (Example 6, Comparative Example 4))

| | | Characteristics after durability test of 500,000 copies | | |
|---|---|---|---|---|
| Surface temperature 50° C. by heating means | | Fusion of toner | Water repellency (contact angle) | Image smearing |
| Ex. 6 | fluorination of the invention | ◎ | ◎ | ◎ |
| Comp. Ex. 4 | no fluorination | Δ | ○ | ◎ |

Comparative Example 4

The deposited film was formed by successive stacking on the cylindrical Al substrate by use of the plasma enhanced CVD system illustrated in FIG. 2 and under the conditions shown in Table 1. Fluorination was not effected.

Next, this photosensitive member was mounted on the modified model of copier NP-5060 available from CANON INC. and the durability test of 500,000 copies was carried out in the same manner as in Example 1. However, the surface of the drum was maintained at about 50° C. by use of a heating device of the drum. The results are shown in Table 9, together with the results of Example 6.

In Comparative Example 4, a trace of fusion appeared in the image and fine fusion was found on the surface of the drum. Since the blade pressure was set higher than in normal use conditions, circumstances were more likely to cause fusion; however, it could be visualized in the image if the copying steps were repeated up to the durability limit required for a-Si drum. In contrast, the drum of Example 6 experienced no fusion even if the surface temperature of drum was raised up to about 50° C. This is possibly because the fluorine present in the surface improves the slip property.

Example 7

The deposited film was formed by successive stacking on the cylindrical Al substrate by use of the VHF plasma CVD system illustrated in FIG. 3 and under the conditions shown in Table 10, at the discharge frequency 105 MHz as an example. For comparison's sake, the photoconductive member was made under the conditions shown in Table 11 and by use of the RF plasma CVD system of the discharge frequency 13.56 MHz as illustrated in FIG. 2. Then etching was carried out by the fluorine plasma under the same conditions as those shown in Table 2.

Next, the same durability test and evaluations as in Example 1 were carried out for each photosensitive member.

The results of obtained characteristics such as image smearing are shown in Table 12. The photosensitive member fabricated by the VHF of 105 MHz can stand comparison with that fabricated by the RF of 13.56 MHz in the all characteristics. In addition, the photosensitive member by the VHF was found to be superior in sensitivity and hardness to that by 13.56 MHz.

TABLE 10

(Fabrication conditions of photosensitive member (VHF-PCVD)

| | |
|---|---|
| Lower preventing layer | $SiH_4$: 200 sccm<br>$H_2$: 500 sccm<br>NO: 10 sccm<br>$B_2H_6$: 2100 ppm<br>power: 100 W<br>internal pressure: 0.02 Torr<br>thickness: 1.5 μm |
| Photoconductive layer | $SiH_4$: 400 sccm<br>$H_2$: 500 sccm<br>power: 600 W<br>internal pressure: 0.015 Torr<br>thickness: 20 μm |
| Surface layer | $CH_4$: 200 sccm<br>power: 1000 W<br>internal pressure: 0.005 Torr<br>thickness: 0.3 μm |

TABLE 11

(Fabrication conditions of photosensitive member (RF-PCVD))

| | |
|---|---|
| Lower preventing layer | $SiH_4$: 200 sccm<br>$H_2$: 500 sccm<br>NO: 10 sccm<br>$B_2H_6$: 2100 ppm<br>power: 100 W<br>internal pressure: 0.2 Torr<br>thickness: 1.5 μm |
| Photoconductive layer | $SiH_4$: 400 sccm<br>$H_2$: 500 sccm<br>power: 600 W<br>internal pressure: 0.45 Torr<br>thickness: 20 μm |
| Surface layer | $CH_4$: 200 sccm<br>power: 1000 W<br>internal pressure: 0.3 Torr<br>thickness: 0.3 μm |

TABLE 12

(Comparison between fabrication methods of surface layer (Example 7))

| | Characteristics after durability test of 100,000 copies | | | | | | | |
|---|---|---|---|---|---|---|---|---|
| | Contact angle | Potential shift | Ghost | Image smearing | Transfer efficiency | Forced jam test | Sensitivity | Hardness |
| 105 MHz | ⊙ | ⊙ | ⊙ | ⊙ | ⊙ | ⊙ | ⊙ | ⊙ |
| 13.56 MHz | ⊙ | ⊙ | ⊙ | ⊙ | ⊙ | ⊙ | ○ | ○ |

EFFECTS OF THE INVENTION

The photosensitive member according to the present invention is characterized in that the surface layer comprised of non-monocrystal carbon is provided on the photoconductive layer, the surface layer has the fluorinated surface, the surface roughness Rz is less than 1000 Å when observed in the small range when the reference length is 5 μm, the fluorine contained in the surface layer is present substantially within 50 Å from the surface, and the concentration of fluorine to carbon in that region is 20% or more; the photosensitive member is excellent in water repellency and provides high-quality images without use of any heating means under high temperature and high humidity circumstances; and the present invention permits such photosensitive members to be fabricated with very good repeatability.

The photosensitive member of the present invention is resistant to adhesion of corona discharge products and the toner fusion hardly occurs thereon because of no need for provision of heating means. Further, the photosensitive member of the present invention is excellent in transfer efficiency and cleanability and provides high-quality images without potential shift and ghost.

What is claimed is:

1. A photosensitive member for electrophotography, which has a photoconductive layer comprised of a non-monocrystal material comprising the matrix of silicon atoms on an electrically conductive substrate, in which a surface layer comprised of non-monocrystal carbon containing at least hydrogen is formed, and in which the surface layer has a surface containing fluorine, wherein the surface roughness Rz is less than 1000 Å when a reference length is 5 μm, and wherein the fluorine contained in the surface layer is present substantially in a region within 50 Å from the surface and a concentration of fluorine to carbon in the region is 20% or more.

2. A photosensitive member for electrophotography according to claim 1, wherein said surface layer is formed using a plasma resulting from decomposition of at least a hydrocarbon-based gas.

3. A photosensitive member for electrophotography according to claim 1 or 2, wherein said surface layer is formed by decomposing at least a hydrocarbon-based gas by a plasma enhanced CVD process using a high frequency in the range of 1 to 450 MHz.

4. A photosensitive member for electrophotography according to claim 3, wherein said surface layer is formed by decomposing at least a hydrocarbon-based gas by a plasma enhanced CVD process using a high frequency in the range of 50 to 450 MHz.

5. A photosensitive member for electrophotography according to claim 1, wherein said surface layer is fluorinated by etching in a plasma resulting from decomposition of a gas containing at least fluorine atoms.

6. A photosensitive member for electrophotography according to claim 5, wherein an etch amount of the non-monocrystal carbon by said etching with the gas containing fluorine atoms is in a range of between a lower limit of 20 Å or more in the direction of thickness of film and an upper limit of 100 Å or more at the thinnest part of the remaining non-monocrystal carbon film.

7. A photosensitive member for electrophotography according to claim 5 or 6, wherein said gas containing fluorine atoms is at least one selected from the group consisting of $CF_4$, $CHF_3$, $CH_2F_2$, $CH_3F$, $C_2F_6$, $C_2F_4$, $CH_2CF_2$, $ClF_3$, $SF_6$, HF, and $F_2$.

8. A photosensitive member for electrophotography according to claim 5, wherein said gas containing fluorine atoms is a gas diluted with at least one gas selected from the groups consisting of He, Ne, Ar, and $N_2$.

9. A fabrication process of a photosensitive member for electrophotography for fabricating a photosensitive member for electrophotography, comprising:

by use of a plasma processing apparatus for generating a plasma between a cathode electrode to which a high-frequency power is applied, and an electrically conductive substrate opposed to said cathode electrode in a reaction vessel the pressure of which is capable of being reduced, and thereby plasma-processing the substrate, depositing a photoconductive layer comprised of a non-monocrystal material comprising the matrix of silicon atoms on the substrate to be processed, providing a surface layer comprised of non-monocrystal carbon containing at least hydrogen, using at least a hydrocarbon-based gas as a source gas, on the photoconductive layer, and etching a surface of the surface layer in a plasma resulting from decomposition of a gas containing at least fluorine atoms, thereby fluorinating the surface, wherein the surface roughness Rz, made in the surface by the etching, is controlled to be less than 1000 Å when a reference length is 5 $\mu$m, and wherein the fluorine contained in the surface layer is made present substantially in a region within 50 Å from the surface and a concentration of fluorine to carbon in the region is controlled to 20% or more.

10. A fabrication process of photosensitive member for electrophotography according to claim 9, wherein said surface layer is formed by a plasma enhanced CVD process using a high frequency in the range of 1 to 450 MHz.

11. A fabrication process of photosensitive member for electrophotography according to claim 10, wherein said surface layer is formed by a plasma enhanced CVD process using a high frequency in the range of 50 to 450 MHz.

12. A fabrication process of photosensitive member for electrophotography according to either one of claims 9 to 11, wherein an etch amount of the non-monocrystal carbon by said etching with the gas containing fluorine atoms is in a range of between a lower limit of 20 Å or more in the direction of thickness of film and an upper limit of 100 Å or more at the thinnest part of the remaining non-monocrystal carbon film.

13. A fabrication process of photosensitive member for electrophotography according to claim 9, wherein said gas containing fluorine atoms is at least one selected from the group consisting of $CF_4$, $CHF_3$, $CH_2F_2$, $CH_3F$, $C_2F_6$, $C_2F_4$, $CH_2CF_2$, $ClF_3$, $SF_6$, HF, and $F_2$.

14. A fabrication process of photosensitive member for electrophotography according to claim 9, wherein said gas containing fluorine atoms is a gas diluted with at least one gas selected from the group consisting of He, Ne, Ar, and $N_2$.

* * * * *

UNITED STATES PATENT AND TRADEMARK OFFICE

CERTIFICATE OF CORRECTION

PATENT NO. : 5,976,745

DATED : November 2, 1999

INVENTOR(S) : AOKI ET AL.

It is certified that error appears in the above-identified patent and that said Letters Patent is hereby corrected as shown below:

COLUMN 22

Line 64, "groups" should read --group--.

Signed and Sealed this

First Day of May, 2001

*Attest:*

Nicholas P. Godici

NICHOLAS P. GODICI

*Attesting Officer*

*Acting Director of the United States Patent and Trademark Office*